United States Patent [19]

O'Brien

[11] Patent Number: 4,909,768

[45] Date of Patent: Mar. 20, 1990

[54] ARCH ADJUSTING MECHANISM FOR WATER SKI BOOTS

[76] Inventor: Herbert J. O'Brien, 13429 NE. 115th Ct., Redmond, Wash. 98052

[21] Appl. No.: 237,529

[22] Filed: Aug. 26, 1988

[51] Int. Cl.[4] ..... A63C 5/00

[52] U.S. Cl. ..... 441/70; 128/598

[58] Field of Search ..... 441/65, 68, 70; 280/11.15, 11.14, 636; D2/314, 264; 36/88, 71, 91; 128/598, 597, 596, 581, 586, 591, 601, 602

[56] References Cited

U.S. PATENT DOCUMENTS

| | | | |
|---|---|---|---|
| 1,242,317 | 10/1917 | Boyajian | 128/597 |
| 1,311,240 | 7/1919 | Mayer | 128/598 |
| 1,558,192 | 10/1925 | Vindgren | 128/597 |
| 2,204,410 | 6/1940 | Ganzer | 128/597 |
| 2,295,364 | 9/1942 | Skorepa | 128/597 |
| 2,390,416 | 12/1945 | Bettmann | 128/597 |
| 3,667,473 | 6/1972 | Matteson | 128/598 |
| 4,398,200 | 6/1983 | O'Brien | 441/70 |

FOREIGN PATENT DOCUMENTS

| | | | |
|---|---|---|---|
| 42167 | 1/1888 | Fed. Rep. of Germany | 128/598 |
| 71786 | 11/1948 | Norway | 128/598 |

*Primary Examiner*—Joseph F. Peters, Jr.
*Assistant Examiner*—Clifford T. Bartz
*Attorney, Agent, or Firm*—Seed and Berry

[57] ABSTRACT

A sole plate in a water ski boot has a central upwardly flexible arch member and screw operated arch adjusting mechanisms at both sides which independently upwardly arch a respective side position of the arch member so that the boot can be adjusted for a right or left boot.

8 Claims, 2 Drawing Sheets

FIG. 3
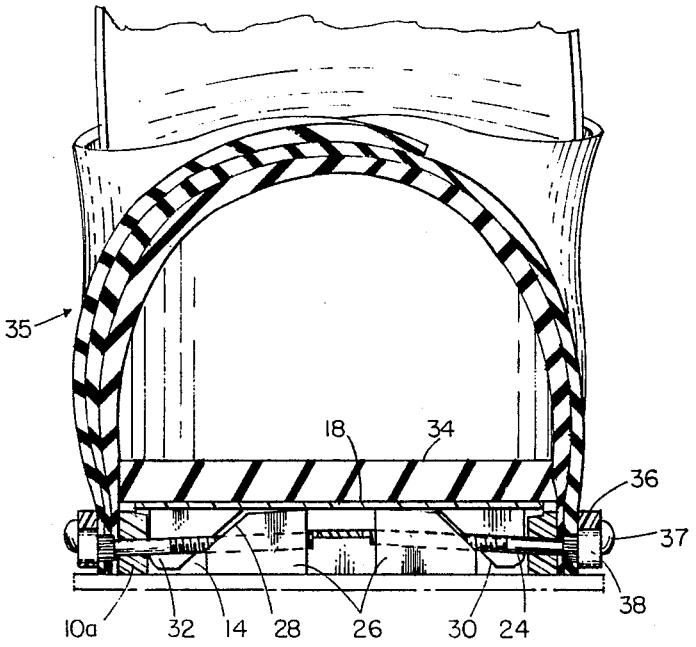
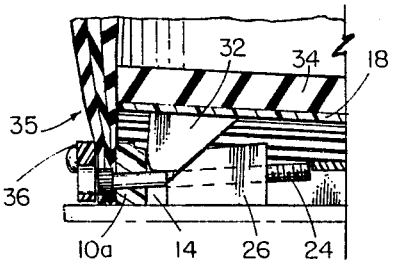
FIG. 4

ARCH ADJUSTING MECHANISM FOR WATER SKI BOOTS

TECHNICAL FIELD

The present invention relates to water ski boots, and more particularly to a mechanism and arrangement for adjusting the arch of the sole plate portion of a water ski boots.

BACKGROUND ART

In the past it has been known to provide an arch adjustment in a walking shoe by adjusting the upward arch of a flexible insole plate. Examples are U.S. Pat No. 899,367 (Winchell); U.S. Pat. No. 1,242,317 (Boyajin); U.S. Pat. No. 1,523,353 (Winchell); and U.S. Pat. No. 2,295,364 (Skorepa). In the later of the two Winchell patents, a turnbuckle is turned at the center to cause beveled nuts to travel along a beveled transverse track to vary the upward arch of a flexible insole member engaged by the nuts on its underside. In the earlier Winchell patent, a lateral screw is turned in a fixed nut to force a bottom brace to flex a sole plate with which it is slidably connected by end tongues passing through slots. In both Winchell patents the adjusting screws are within the shoe. The Boyajin patent has a flexible inside plate anchored at its forward end and adjusted longitudinally to bend the plate upwardly by a screw operating in a cavity hidden at the top of the shoe heel. The Skorepa patent discloses a similar device in which access to the adjusting screw is had by removing an end plug in the heel. None of these prior art arch adjusting mechanisms is considered suitable or practical for use with a water ski boat.

A water ski boot needs to be adapted to be used with a right or left foot. Hence, if there is to be an arch support for the foot in the boot, it must be not only adjustable in height for comfort by various skiers, it should be adjustable such as to provide an arch support at either side depending upon which foot the water ski is to be mounted. Furthermore, there should be easy access to the adjusting mechanism.

DISCLOSURE OF THE INVENTION

The present invention aims to meet these needs in a relatively simple and economical manner by providing a flexible arch member which has its width extending across most of the width of the sole plate of the boot and can be arched upwardly at either side by a respective adjusting mechanism operated by a screw having an exposed head for receiving a screw driver. The adjusting screws move respective slide blocks transversely of a sole plate which responsively wedge cams upwardly that are mounted on the underside of the arch member and depend into a cavity at the underside of the sole plate wherein the slide blocks are housed. The upward arching of the arch member is permitted by way of end tongues on the arch member fitting into transverse slots in the sole plate.

BRIEF DESCRIPTION OF THE DRAWINGS

FIG. 3 is a transverse vertical sectional view taken as indicated by the line 3—3 in FIG. 1; and FIG. 4 is a fragmentary sectional view taken like FIG. 3 and showing the arch member raised on one side of the boot.

BEST MODE FOR CARRYING OUT THE INVENTION

Figure 1:
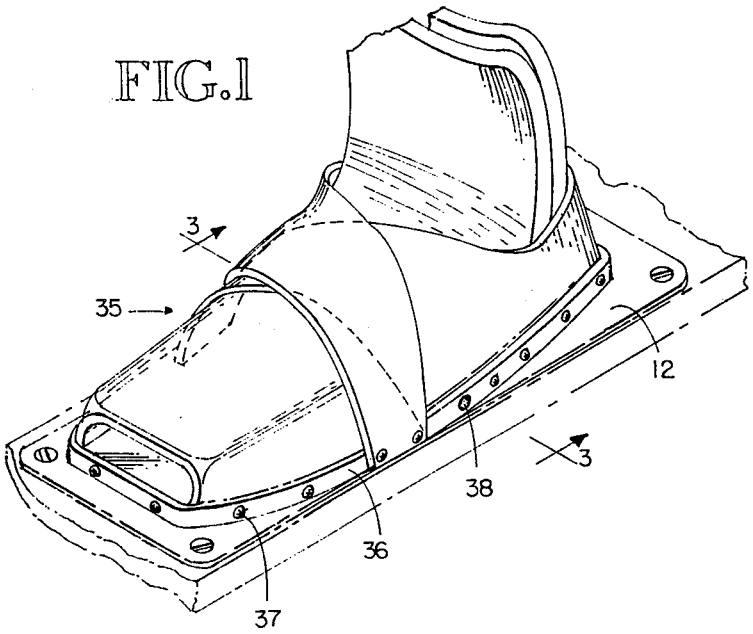
FIG. 1 is a perspective view of a water ski boot equipped with the present invention and mounted on a water ski shown in phantoms.
Figure 2:
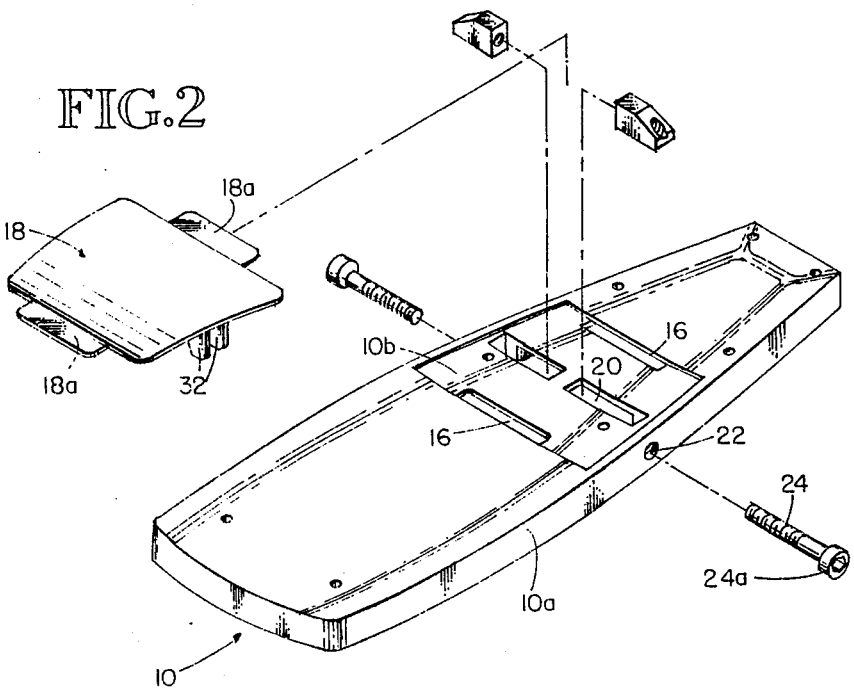
FIG. 2 is an exploded perspective view of the sole plate and related parts of the arch adjustment mechanism.

Referring to the drawings, a molded plastic sole plate 10 is provided which may have the general shape of the sole plate in U.S. Pat. No. 4,389,200 and is adapted to screw mounted from the underside on a water ski mounting plate 12. The sole plate 10 has a peripheral skirt flange 10*a* seated on the mounting plate and providing a cavity 14 between the sole plate and the mounting plate 12. Centrally of the sole plate there is a recessed portion 106 having at its ends a pair of transverse through slots 16 spaced apart longitudinally of the sole plate to receive flexible end tongues 18*a* presented by a flexible arch member 18. The recessed portion 106 also has a pair of central aligned transversely extending slots 20 which are intersected at their outer ends by holes 22 passing through the skirt flange 10*a*. Extending freely through these holes 22 are a pair of adjustment screws 24 which are threaded into a pair of slide blocks 26 riding in the slots 20. These slide blocks have outwardly sloped wedge faces 28 at their outer ends which engage the sloped opposed inner edges 30 of two pairs of lifting cam ears 32 which depend integrally from the arch member 18 adjacent opposite sides edge portions of the skirt flange 10*a*. The adjustment screws 24 extend between the two cam ears of respective two pairs to reach from the skirt flange 10*a* to the slide blocks 26.

The arch member 18 with its integral end tongues 18*a* is flexible enough that it can be installed by arching it upwardly sufficiently to pass the tongues 18*a* through the slots 16 from above the sole plate 10 and then position the cam ears 32 in the outer end portions of the slots 20. Before or after this installation of the arch member 18, the slide blocks 26 are positioned in the slots 20 and the adjustment screws 24 are introduced through the skirt flange holes 22 and threaded into the slide blocks. The slide blocks 26 are in effect traveling nuts, and since the screws 24 are restrained by engagement of their heads 24*a* with the outer face of the skirt flange 10*a* from inward travel, and the slide blocks are restrained by the front and back longitudinal edges of the slots 20 from turning, they slide along these slots responsive to turning of the screws 24.

When the adjustment screws 24 are turned clockwise the slide blocks walk outwardly toward the skirt flange 10*a* so that the sloped outer faces 28 of the blocks engage the inner cam edges 30 of the cam ears 32. Further clockwise turning causes the cam ears 32 to lift relative to the sole plate 10, and hence cause the overlying part of the arch member to lift and arch upwardly away from the sole plate. The tongues 10*a* continue to retain the arch member 18 and slide in the slots 16 sufficiently to permit the upward bending of the arch member.

The arch member 18 and sole plate 10 are preferably covered by a soft elastic sole pad 34 for foot comfort. This pad 34 may be adhesively bonded to the upper face of the sole plate 10 endways of the arch member 18 and has sufficient elasticity to permit upward arching adjustment of the arch member.

It is preferred to hold the flexible foot covering portions of the water ski binding 35 in place by peripheral clamping strips 36 held by screws 37 passing through the strips and foot covering parts of the binding into the edges of the sole plate 10 as shown in U.S. Pat. No. 4,389,200. The strips 36 have holes 38 aligned with the screws 24 so that the heads 24a of the screws are exposed to receive an adjusting tool. The holes 38 are preferably smaller in diameter than the heads 24a of the screws 24 so that the screws are restrained from backing away from the sole plate when turned to lower the arch member 18.

Except for the screws 24, which are preferably of stainless steel, all of the parts of the arch adjusting mechanism may be made of plastic to maximize corrosion resistance and for cost reduction. Since each screw 24 adjusts only a respective instep portion of the arch member 18 it is possible to easily adjust and raise the instep for the right or left foot as indicated in FIG. 4 for the instep of the left foot.

Although the foregoing invention has been described, in part, by way of illustration for the purposes of clarity and understanding, it will be apparent that certain changes or modifications will be practiced without deviating from the spirit and scope of the invention.

I claim:

1. A water ski boot assembly comprising:

a boot having an elongated sole plate formed with a bottom cavity, a first pair of longitudinally spaced transverse slots, and a second pair of aligned transverse slots located between said first pair;

a flexible arch member above said sole plate and having opposite end portions extending through said first pair of slots, said arch member having a pair of cam elements depending therefrom into respective ones of said second pair of slots;

a pair of slide blocks slidably mounted in respective ones of said second pair of slots;

and a pair of adjusting screws extending inwardly through opposite sides of said sole plate into threaded engagement with respective ones of said slide blocks, said cam elements and slide blocks being arranged and shaped such that independent turning of either of said screws causes engagement of the respective slide block with the respective cam element and raising thereof to responsively arch the corresponding side portion of the arch member upwardly.

2. A water ski boot assembly according to claim 1 in which said slide blocks have wedge faces opposing said cam elements.

3. A water ski boot assembly according to claim 1 in which said sole plate has a second pair of cam elements depending therefrom into each of said second slots and spaced endwise of said sole plate by gaps from said first mentioned pair of cam elements, and in which said adjusting screws extend into said gaps.

4. A water ski boot assembly according to claim 1 in which an elastic insole member covers said arch member and the adjoining portions of said sole plate within said boot.

5. A water ski boot assembly according to claim 4 in which said insole member is connected by adhesive to said sole plate.

6. A water ski boot assembly according to claim 1 in which a water ski mounting plate covers the underside of said sole plate.

7. A water ski boot assembly according to claim 1 in which means are provided for preventing said adjusting screws from backing away from said side plate.

8. A water ski boot assembly comprising:

a boot having an elongated slot plate formed with a bottom cavity, first transverse slot means, and second transverse slot means spaced longitudinally of said sole plate from said first slot means;

a flexible arch member above said sole plate and having an end portion extending through said first slot means, said arch member having two cam elements depending therefrom into said second slot means, said cam elements being spaced apart transversely of said sole plate, said second slot means engaging said cam elements;

a pair of side blocks slidably mounted in said second slot means two adjusting screws extending from exposed heads inwardly through opposite sides of said sole plate into threaded engagement with respective ones of said slide blocks, said cam elements and slide blocks being arranged and shaped such that independent turning of either of said screws causes engagement of the respective slide block with the respective cam element and raising thereof to responsively arch the corresponding side portion of the arch member upwardly; and a water ski mounting plate on the underside of said sole plate and covering said cavity.

* * * * *

UNITED STATES PATENT AND TRADEMARK OFFICE

CERTIFICATE OF CORRECTION

PATENT NO. : 4,909,768

DATED : March 20, 1990

INVENTOR(S) : Herbert J. O'Brien

It is certified that error appears in the above-identified patent and that said Letters Patent is hereby corrected as shown below:

In claim 8, column 4, line 24, delete "slot" and substitute therefor --sole--.

Signed and Sealed this

Twenty-eighth Day of May, 1991

*Attest:*

HARRY F. MANBECK, JR.

*Attesting Officer*

*Commissioner of Patents and Trademarks*